United States Patent [19]

Barrat et al.

[11] 4,416,794

[45] Nov. 22, 1983

[54] RINSE AID COMPOSITIONS CONTAINING AMINO-SILANES

[75] Inventors: Christian R. Barrat; John R. Walker, both of Brussels; Jean Wevers, Strombeek-Bever, all of Belgium

[73] Assignee: The Procter & Gamble Company, Cincinnati, Ohio

[21] Appl. No.: 421,185

[22] Filed: Sep. 22, 1982

[30] Foreign Application Priority Data

Sep. 25, 1981 [GB] United Kingdom ..... 81/29067

[51] Int. Cl.[3] ..... C11D 3/30

[52] U.S. Cl. ..... 252/174.15; 252/174.21; 252/173; 252/541; 252/544; 252/DIG. 14

[58] Field of Search ..... 252/8.6, 8.8, 98, 99, 252/102, 541, 544, 156, 174.15, 174.21, 173

[56] References Cited

U.S. PATENT DOCUMENTS

| | | | |
|---|---|---|---|
| 2,971,864 | 2/1961 | Speier | 427/388 |
| 2,972,598 | 2/1961 | Morehouse | 260/46.5 |
| 3,033,815 | 5/1962 | Pike et al. | 260/46.5 |
| 3,085,908 | 4/1963 | Morehouse et al. | 427/388 R X |
| 3,175,921 | 3/1965 | Hedlund | 427/409 |
| 3,876,459 | 4/1975 | Burrill | 427/387 |
| 4,005,024 | 1/1977 | Rodriguez et al. | 252/174.15 X |
| 4,005,025 | 1/1977 | Kinstedt | 252/547 X |
| 4,005,028 | 1/1977 | Heckert et al. | 252/99 |
| 4,005,030 | 1/1977 | Heckert et al. | 252/174.15 |
| 4,005,118 | 1/1977 | Heckert et al. | 252/546 |
| 4,062,999 | 12/1977 | Kondo et al. | 428/391 |
| 4,137,179 | 1/1979 | Koerner et al. | 252/8.6 |
| 4,152,273 | 5/1979 | Weiland | 252/8.8 |

FOREIGN PATENT DOCUMENTS

| | | |
|---|---|---|
| 753603 | 2/1967 | Canada . |
| 1793280 | 2/1972 | Fed. Rep. of Germany . |
| 2843709 | 4/1979 | Fed. Rep. of Germany . |
| 1207724 | 2/1960 | France . |
| 2299447 | 8/1976 | France . |
| 858445 | 1/1961 | United Kingdom . |

OTHER PUBLICATIONS

U.S. Ser. Nos. 421,185; 421,186; 421,187; 421,182; 421,183, Barrat et al, filed 9/22/82.

*Primary Examiner*—P. E. Willis, Jr.
*Attorney, Agent, or Firm*—Donald E. Hasse; Edmund F. Gebhardt; Robert B. Aylor

[57] ABSTRACT

A liquid rinse aid for use in automatic dishwashing machines comprises a low foaming ethoxylated non-ionic surfactant, an organic chelating agent, a hydrotrope-water solubilizing system and 0.05–10%, by weight of the rinse aid, of an amino-silane.

6 Claims, No Drawings

RINSE AID COMPOSITIONS CONTAINING AMINO-SILANES

FIELD OF THE INVENTION

This invention relates to rinse aid compositions for use in automatic dishwashing machines of both industrial and domestic type containing low levels of specific aminosilanes.

BACKGROUND OF THE INVENTION

Automatic dishwashing (hereinafter ADW) machines employ a variety of wash cycles, or in the case of commercial practice, a variety of machine stages, which usually include a pre-rinse, one or more spray washings using an aqueous detergent solution, and one or more rinses to remove residual detergent and loosened soil. In the majority of modern machines, a rinse aid composition is added, via a separate dispenser, to the final rinse cycle or stage, which composition serves to promote wetting, enhance sheet flow production and increase the rate of water drainage, thereby reducing water spotting on the washed and dried tableware. The rinse aid, which is liquid, contains a low foaming nonionic surfactant and a chelating agent in a hydrotrope-water solubilizing system.

In areas where the water supply has a low level of mineral hardness, i.e., $\leqq 50$ ppm expressed as $CaCO_3$, or in ADW machines whose water supply is presoftened, it has been noticed that glassware subjected to repetitive washing in an ADW machine develops a surface cloudiness which is irreversible. Under similar treatment conditions, decorated china articles such as plates and dishes also show surface deterioration. These effects often manifest themselves as an iridescent film that displays rainbow hues in light reflected from the surface of the article and the effects become progressively more pronounced with repeated treatment. Whilst the origin of this surface damage has not been definitely established, it is believed that the problem arises from chelating agent carried over from the wash or contained in the rinse aid, attacking the surface during the final rinse or the subsequent drying step.

The effect of detergents on glassware in domestic dishwashers is discussed in a paper entitled "The present position of investigations into the behaviour of glass during mechanical dishwashing" presented by Th. Altenschoepfer in April 1971 at a symposium in Charleroi, Belgium. It had been recognized that the use of metal ions such as zinc in mechanical dishwashing detergent compositions contributes towards the inhibition of corrosion.

Silanes and amino-silanes are widely used in the chemical industry, mostly as coupling agents between inorganic and organic surfaces. These compounds have also found application for metal-surface protection. The protective treatment is applied from an aqueous medium, possibly from solvent systems containing lower alcohols and water, depending upon the characteristics of the silanes. Representative of this state of the art are: U.S. Pat. No. 3,085,908, Morehouse et al., U.S. Pat. No. 3,175,921, Hedlund, and French Pat. No. 1,207,724, Morehouse et al.

The modification of siliceous surfaces for the purpose of conferring various properties is known in the art. Examples include U.S. Pat. Nos. 4,005,118 and 4,005,025 which utilize quaternized amino-silanes to provide soil release properties to vitreous enamel and glass articles when applied from a wash or rinse solution, and U.S. Pat. No. 2,971,865 which employs unquaternized amino-silanes as coupling compounds to attach certain type of dyestuff to glassware.

The preparation of a broad class of gamma-aminopropylalkoxysilanes is known from German Application DOS No. 17 93 280.

None of the above references discuss the corrosion of glass or decorated vitreous enamel ware arising from treatment with a solution of a chelating agent in water of low mineral hardness and close to neutral pH, such as takes place when a conventionally formulated rinse aid is added to the final rinse stage of an ADW machine cycle. It has now surprisingly been found that the addition of certain aminosilanes to the final rinse substantially eliminates this soft water corrosion.

SUMMARY OF THE INVENTION

Accordingly, the present invention provides a liquid rinse aid composition for use in an automatic dishwashing machine comprising from 1–40% by weight of a low foaming ethoxylated nonionic surfactant, from 0–30% by weight of an organic chelating agent and a hydrotrope-water solubilising system wherein the composition comprises from 0.05%–10% by weight of an amino-silane of the general formula:

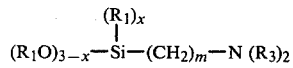

$R_1 = C_{1-4}$-alkyl or $C_{1-4}$-hydroxyalkyl;
x is 0 or 1;
m is 1–6;
$R_3$ is hydrogen, $R_1$,

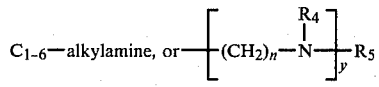

$R_4$ is hydrogen or $R_1$;
n is 1–6;
y is 0–6;
$R_5 = R_4$,

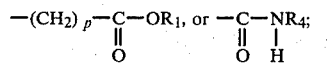

p = 1–6.
The $R_3$'s can be identical or different.

DETAILED DESCRIPTION OF THE INVENTION

Rinse aid compositions in accordance with the invention comprise a low foaming ethoxylated nonionic surfactant, normally an organic chelating agent, an amino-silane corrosion inhibitor and an aqueous solubilising system.

Nonionic surfactants which are advantageously employed in the composition of this invention include, but are not limited to, the following polyoxyalkylene nonionic detergents: $C_8$–$C_{22}$ normal fatty alcohol-ethylene oxide condensates i.e., condensation products of one mole of a fatty alcohol containing from 8 to 22 carbon atoms with from 2 to 20 moles of ethylene oxide; polyoxypropylene-polyoxyethylene condensates having the formula:

$$HO(C_2H_4O)_x(C_3H_6O)_y(C_2H_4O)_{x1}H$$

wherein y equals at least 15 and $(C_2H_4O)_{x+x1}$ equals 20–90% of the total weight of the compound; alkyl polyoxypropylenepolyoxyethylene condensates having the formula $$RO—(C_3H_6O)_x(C_2H_4O)_yH$$

where R is a $C_1$–$C_{15}$ alkyl group and x and y each represent an integer from 2 to 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, linked by two hydrophilic chains, the central hydrophobic chain constituting 30% to 34% by weight of the product, the linking hydrophilic chains together constituting 31% to 35% by weight of the product, the intrinsic viscosity of the product being from 0.06 to 0.09 and the molecular weight being from 3,000 to 5,000 (all as described in U.S. Pat. No. 3,048,548); butylene oxide capped alcohol ethoxylates having the formula $$R(OC_2H_4)_y(OC_4H_8)_xOH$$

where R is a $C_8$–$C_{18}$ alkyl group and y is from 3.5 to 10 and x is from 0.5 to 1.5; benzyl ethers of polyoxyethylene condensates of alkyl phenols having the formula

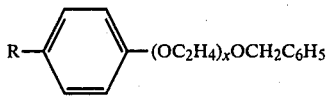

where R is a $C_6$–$C_{20}$ alkyl group and x is an integer from 5 to 40; and alkyl phenoxy polyoxyethylene ethanols having the formula

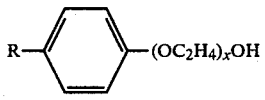

where R is a $C_8$–$C_{20}$ alkyl group and x is an integer from 3 to 20. Other nonionic detergents are suitable for use in the herein disclosed rinse aid compositions and it is not intended to exclude any detergent possessing the desired attributes.

Preferred nonionic surfactants are the condensates of from 2 to 15 moles of ethylene oxide with one mole of a $C_8$–$C_{20}$ aliphatic alcohol. Particularly preferred surfactants are those based on ethylene oxide condensates with primarily aliphatic alcohols made by the "oxo" process. These alcohols are predominantly straight-chain aliphatic alcohols, with up to 25% of short-chain branching at the 2-position. A suitable range of alcohol ethoxylates is made by the Shell Chemical Company and is sold under the trade name "Dobanol". A particularly preferred material of this type is Dobanol 45-4, which is the reaction product of 4 moles of ethylene oxide with 1 mole of a $C_{14}$–$C_{15}$ oxo-alcohol. Another preferred commercially available range of surfactants is based on the ethoxylates of relatively highly branched alcohols, containing up to 60% of $C_1$–$C_6$ branching at the 2-position. These alcohols are sold under the trade name "Lial" by Liquichimica Italiana. A preferred material is Lial 125-4, the condensation product of 4 moles of ethylene oxide with a $C_{12}$–$C_{15}$ alcohol.

Further examples of suitable nonionic surfactants can be found in Brit. Pat. No. 1,477,029.

The level of nonionic surfactant can be from 1–40% by weight preferably 10–25% by weight of the rinse aid.

The chelating agent can be any one of a wide range of organic or inorganic sequestering agents, examples including phosphoric acid, amino polycarboxylic acids such as EDTA, NTA and DETPA and polycarboxylic acids such as lactic acid, citric acid, tartaric acid, gluconic acid, glucoheptonic acid, mucic acid, galactonic acid, saccharic acid, fumaric acid, succinic acid, glutaric acid, adipic acid and their alkali metal or ammonium salts. Citric or tartaric acid are preferred chelating acids. The chelating agent if included is present in an amount of up to 30% and normally lies in the range 5% to 20% by weight. Highly preferred compositions use 5–10% by weight of chelating agent in order to minimise any attack by the chelating agent on the glass.

The essential amino-silane component can be used at levels from 0.05% to 10% preferably from 0.1% to 5% and most preferably from 0.5% to 3% by weight of the rinse aid composition. Using less than 0.05% will not any more produce the benefits of the invention whereas the use of levels above 10% will not provide additional benefits.

The amino-silane component has the formula:

$$(R_1O)_{3-x}—\overset{(R_1)_x}{\overset{|}{Si}}—(CH_2)_m—N(R_3)_2$$

wherein:

$R_1$ = $C_{1-4}$-alkyl or $C_{1-4}$-hydroxyalkyl;

x is 0 or 1;

m is 1–6;

$R_3$ is hydrogen, $R_1$, $$C_{1-6}\text{—alkylamine, or}—\left[(CH_2)_n—\overset{R_4}{\overset{|}{N}}\right]_y—R_5$$

$R_4$ is hydrogen or $R_1$;

n is 1–6;

y is 0–6;

$R_5$ = $R_4$, $$—(CH_2)_p—\underset{\underset{O}{\|}}{C}—OR_1\text{, or }—\underset{\underset{O}{\|}}{C}—\underset{\underset{H}{|}}{N}—R_4;$$

p = 1–6.

The $R_3$'s can be identical or different.

Preferred amino-silanes for use herein can carry the following substituents:

$R_1$ = —$CH_3$ or —$C_2H_5$, x = 0 m = 2 or 3

$R_3$ = hydrogen and

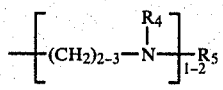

$R_4$=hydrogen or methyl $R_5$=hydrogen or methyl.

The most preferred amino-silanes have the following chemical formula:

$$(CH_3—O)_3—Si(CH_2)_3—NH—(CH_2)_2—NH_2 \quad (a)$$

$$(CH_3—O)_3—Si(CH_2)_3—NH—(CH_2)_3—NH_2 \quad (b)$$

$$(CH_3—O)_3—Si(CH_2)_3—NH—(CH_2)_2—NH(CH_2)_2—NH_2 \quad (c)$$

The above structural formulae correspond to the following chemical names:

N-(trimethoxysilylpropyl)-ethylene diamine (a)

N-(trimethoxysilylpropyl)-propylene diamine (b)

N-(trimethoxysilylpropyl)-diethylene triamine (c)

An additional component of the rinse aid formulation may be a water soluble magnesium zinc or bismuth salt which assists in preventing filming and corrosion of glassware under the conditions of the rinsing operation.

The magnesium, zinc or bismuth salts may be chosen from any water soluble salt of these metals. The chloride, sulphate or acetate of zinc and magnesium may be used although the chloride is preferred for reasons of convenience and economy. Bismuth lactate is the preferred bismuth salt by reason of its appreciable solubility. The level of salt is selected so as to provide from 0.1%–10% of metal ions. For the preferred magnesium and zinc salts this corresponds to approximately 0.2%–20% $ZnCl_2$ and 0.5%–53% $MgCl_26H_2O$. Normally the range of metal ion content is from 1–10% and preferably is from 2–5% corresponding to 4–10% $ZnCl_2$ and 10–26% $MgCl_26H_2O$. These compositions are more fully described in the copending British Application No. 81 22039 filed July 8, 1981 and entitled "Rinse aid composition".

The balance of the rinse aid formulation comprises a solubilising system which is water optionally together with 1–25% preferably 2–20% by weight of the composition of hydrotrope which may be ethanol, isopropanol, a lower alkyl benzene sulphonate such as toluene, xylene or cumene sulphonate or a mixture of any of these.

The invention is illustrated in the following examples in which all percentages are by weight of the composition.

EXAMPLE

An automatic dishwashing detergent composition and its companion rinse aid product were formulated as shown below:

| ADW Cleaner | | ADW rinse aid | |
|---|---|---|---|
| Nonionic(1) | 1.0 | Nonionic(2) | 13.5 |
| Sodium tripolyphosphate | 39.0 | Citric acid | 17.5 |
| Silicate | 26.0 | Water | up to 100 |
| Sodium dichloroiso-cyanurate | 1.5 | pH 2.5 | |
| Sodium carbonate | 10.0 | | |

-continued

| ADW Cleaner | | ADW rinse aid |
|---|---|---|
| Water | 22.5 | |

Nonionic Surfactants (1)67.5% $C_{13}$ 32.5% $C_{15}$ primary aliphatic alcohol condensed with 3 moles ethylene oxide and 4 moles propylene oxide per mole of alcohol.

(2)67.5% $C_{13}$ 32.5% primary aliphatic condensed with 5.75 moles of ethylene oxide and 2.85 moles propylene oxide per mole of alcohol.

Test loads of decorated china dishes, vitreous enamel pans and glassware were subjected to washing cycles in a Bauknecht 6S 4815 ADW machine using the Programme 2 setting at 65° C. This programme consists of one mainwash with a cool-down step at the end, one final rinse and a drying step. The maximum temperature reached during the wash is approximately 65° C. and the whole programme takes between 45 and 60 minutes.

Product usage was 40 g. detergent product and 3.5 ml rinse aid per cycle. N-(trimethoxysilylpropyl)-ethylene diamine—was incorporated into the rinse aid at 2% by weight of the rinse aid and the results of an 80-cycle washing test are shown below.

In the results, the surface appearance of items treated with a rinse aid containing the amino-silane are compared with that of items treated with a rinse aid containing no amino-silane.

| Items | No. of Samples | No. of items on which silane treatment better | equal | worse |
|---|---|---|---|---|
| decorated dishes | 14 | 13 | 1 | 0 |
| decorated glasses | 3 | 3 | 0 | 0 |
| enamel pans | 2 | 1 | 1 | 0 |

It can be seen that inclusion of an amino-silane in an ADW rinse aid provides enhanced protection of the surface appearance of decorated dishes and glassware and enamel pans treated therein relative to treatment with an ADW rinse aid not containing the amino-silane.

We claim:

1. A liquid rinse aid composition for use in an automatic dishwashing machine comprising from 1–40% by weight of a low foaming ethoxylated nonionic surfactant, from 0–30% by weight of an organic chelating agent and a hydrotrope-water solubilising system characterised in that the composition comprises from 0.05–10% by weight of an amino-silane of the general formula:

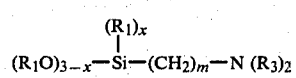

$R_1$=$C_{1-4}$-alkyl or $C_{1-4}$-hydroxyalkyl;

x is 0 or 1;

m is 1–6;

$R_3$ is hydrogen, $R_1$,

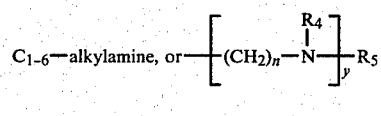

$R_5$ $R_4$ is hydrogen or $R_1$;

n is 1–6;

y is 0–6;

$R_5$=$R_4$, $C_{1-6}$—alkylamine, or $-\left[(CH_2)_n-\overset{R_4}{\overset{|}{N}}\right]_y-R_5$ p=1-6.

2. A liquid rinse aid composition according to claim 1 wherein the amino-silane is present in an amount of from 0.1% to 5% by weight.

3. The composition in accordance with claim 1 wherein the substituents of the amino-silane are as follows:

$R_1$=—$CH_3$ or —$C_2H_5$, x=0 m=2 or 3

$R_3$=hydrogen and $-\left[(CH_2)_{2-3}-\overset{R_4}{\overset{|}{N}}\right]_{1-2}-R_5$ $R_4$=hydrogen or methyl $R_5$=hydrogen or methyl.

4. The composition in accordance with claim 1 wherein the aminosilane is selected from the group consisting of:

$(CH_3—O)_3—Si—(CH_2)_3—NH—(CH_2)_2—NH_2$ $(CH_3—O)_3—Si—(CH_2)_3—NH—(CH_2)_3—NH_2$ $(CH_3—O)_3—Si—(CH_2)_3—NH—(CH_2)_2—NH(CH_2)_2NH_2$

5. A liquid composition according to any one of claims 1-4 characterised in that the composition comprises from 0.1-10% by weight of $Mg^{++}$, $Zn^{++}$ or $Bi^{++}$ ions in the form of a water soluble salt thereof.

6. A liquid composition according to claim 5 wherein the water soluble salt comprises magnesium or zinc chloride in an amount of from 2-5% by weight of the composition.

* * * * *

UNITED STATES PATENT AND TRADEMARK OFFICE

CERTIFICATE OF CORRECTION

PATENT NO. : 4,416,794

DATED : November 22, 1983

INVENTOR(S) : Christian R. Barrat et al

It is certified that error appears in the above-identified patent and that said Letters Patent are hereby corrected as shown below:

Column 2, line 2, "2,971,865" should read --2,971,864--.

Claim 1, column 7, line 5,

"$C_{1-6}$-alkylamine, or $-\left[(CH_2)_n - \overset{R_4}{\overset{|}{N}}\right]_y - R_5$"

should read $-(CH_2)_p-\underset{\underset{O}{\|}}{C}-OR_1$, or $-\underset{\underset{O}{\|}}{C}-\underset{\underset{H}{|}}{N}R_4$;.

Signed and Sealed this

Twenty-fourth Day of April 1984

[SEAL]

Attest:

GERALD J. MOSSINGHOFF

Attesting Officer

Commissioner of Patents and Trademarks